US005231931A

United States Patent [19]

Sauvageot

[11] Patent Number: 5,231,931

[45] Date of Patent: Aug. 3, 1993

[54] RAPID TRANSIT VIADUCT SYSTEM

[75] Inventor: Gerard Sauvageot, Poway, Calif.

[73] Assignee: J. Muller International, San Diego, Calif.

[21] Appl. No.: 839,858

[22] Filed: Feb. 21, 1992

Related U.S. Application Data

[63] Continuation-in-part of Ser. No. 824,502, Jan. 23, 1992, abandoned.

[51] Int. Cl.[5] ..... E01B 3/00

[52] U.S. Cl. ..... 104/124; 104/125

[58] Field of Search ..... 104/125, 125; 404/1; 52/224, 266, 230, 227, 225; 14/18, 19, 20, 25

[56] References Cited

U.S. PATENT DOCUMENTS

| | | | |
|---|---|---|---|
| D. 129,200 | 8/1941 | Heinze | 104/124 |
| 427,836 | 5/1890 | Clarke | 104/124 |
| 1,128,047 | 2/1915 | Rhett | 104/124 |
| 2,155,121 | 4/1939 | Finsterwalder | 52/225 |
| 2,225,186 | 12/1940 | Sorensen | 94/1 |
| 2,226,432 | 12/1940 | Heinze | 104/124 |
| 3,212,453 | 10/1965 | Lich | 104/124 |
| 3,225,703 | 12/1965 | Lemcke | 104/125 |
| 3,662,656 | 5/1972 | Finsterwalder et al. | 94/1 |
| 3,892,096 | 7/1975 | Macchi | 52/227 |
| 4,142,468 | 3/1979 | Birnstiel | 104/124 |
| 4,181,995 | 1/1990 | Zur | 94/ |
| 4,313,383 | 2/1982 | Parazader | 104/124 |
| 4,473,915 | 10/1984 | Finsterwalder | 14/18 |
| 4,505,081 | 3/1985 | Dinis et al. | 52/230 |
| 4,665,830 | 5/1987 | Anderson et al. | 104/124 |
| 4,704,754 | 11/1987 | Bonasso | 14/19 |
| 4,878,327 | 11/1989 | Nutzel et al. | 52/230 |

FOREIGN PATENT DOCUMENTS

| | | | |
|---|---|---|---|
| 1056325 | 2/1954 | France | 14/18 |
| 0023639 | 10/1896 | United Kingdom | 104/124 |

*Primary Examiner*—Mark T. Le

*Attorney, Agent, or Firm*—Baker, Maxham, Jester & Meador

[57] ABSTRACT

A rapid transit viaduct system includes a central load bearing body having a pair of lateral platform structures mounted on opposite lower side portions thereof for carrying one or more rapid transit vehicles on either side of the central load bearing body. The viaduct system further includes vertically extending piers positioned below and supporting the central load bearing body.

20 Claims, 7 Drawing Sheets

RAPID TRANSIT VIADUCT SYSTEM

RELATED APPLICATIONS

The present application is a continuation in part of application Ser. No. 07/824,502, filed Jan. 23, 1992, now abandoned.

BACKGROUND OF THE INVENTION

The present invention relates to viaduct systems for rail and rapid transit lines.

The current technology used for rail and rapid transit viaducts is based on the experience developed for road viaducts. FIG. 1 illustrates a prior art viaduct structure wherein sets of rails are supported on a concrete platform or deck. The deck is mounted on top of a plurality of longitudinal support beams which are in turn mounted on top of transverse pier caps cast from concrete. The longitudinal support beams are steel girders. In another prior art construction, illustrated in FIG. 2, the rails are supported on top of a longitudinal box section mounted on piers. The box section is cast from concrete.

The prior art viaduct structures are disadvantageous from the standpoint of cost, aesthetics, safety and noise. In most rapid transit designs, a minimum clearance height is required between the ground and the rail support structure, with a 15 foot minimum being typical In prior art structures, the actual height of the rapid transit vehicle is substantially above the minimum clearance height. In the construction of FIG. 1, the rail height is determined by the combined depth of the pier cap, the longitudinal support girders and the concrete deck. In the construction of FIG. 2, the rails are placed on top of the full depth of the load bearing box section. In either construction, it is impractical to minimize track height by reducing the depth of the longitudinal load bearing structures. Indeed, a design constraint of railway viaduct systems is that vertical load deflections be kept to a minimum to reduce the possibility of derailment. The longitudinal load bearing structures should thus have good bending stiffness, which is achieved most efficiently with tall bending sections having large moments of inertia.

FIGS. 1 and 2 illustrate the relative disadvantages of the prior art designs in terms of added rail height, as represented by the difference between the track level and the street clearance. As a result of this excessive rail height, increased costs are incurred for additional pier foundation materials in order to withstand transverse loads induced by trains on the substructure. Such loading creates bending moments at the pier foundations in direct proportion to track height. Additional costs are also incurred as a result of having to build higher station platforms in order to reach the track level.

From an aesthetics standpoint, the increased height of the prior art viaduct structures means that the entire structure is more visible from ground locations. From a safety standpoint, the prior art designs do nothing to reduce the possibility of collisions should a derailment occur. As to noise, there are often no structures provided to minimize vehicle sound levels at ground level.

SUMMARY OF THE INVENTION

It is therefore a primary object of the present invention to provide an improved rapid transit viaduct system which provides advantages of reduced cost, improved aesthetics, enhanced safety and limited noise pollution. To that end, a rapid transit viaduct structure is defined cross-sectionally by a central load bearing span or body member and a pair of lateral platform structures mounted to opposite lower side portions of the central load bearing body. The lateral platform structures carry one or more rapid transit vehicles on either side of the central body member. The viaduct structure is supported between vertically extending piers positioned below the central body member.

BRIEF DESCRIPTION OF THE DRAWINGS

The objects, advantages and features of the invention are disclosed in more detail below in conjunction with the accompanying drawings in which.

DETAILED DESCRIPTION OF THE PREFERRED EMBODIMENTS

Figure 1:
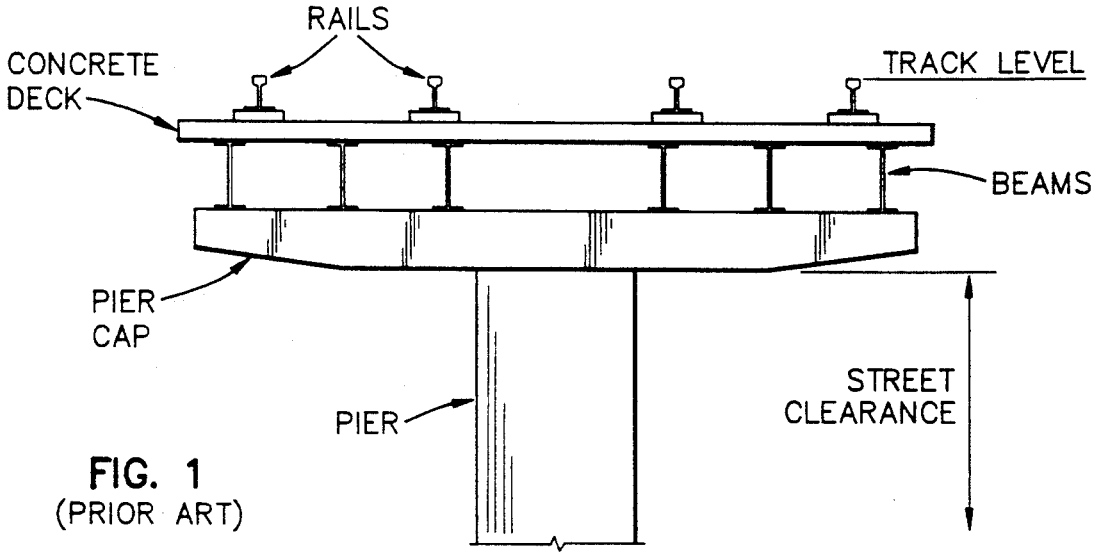
FIG. 1 (PRIOR ART)
FIG. 1 is a diagrammatic view showing a cross-section of a first prior art rapid transit viaduct structure.
Figure 2:
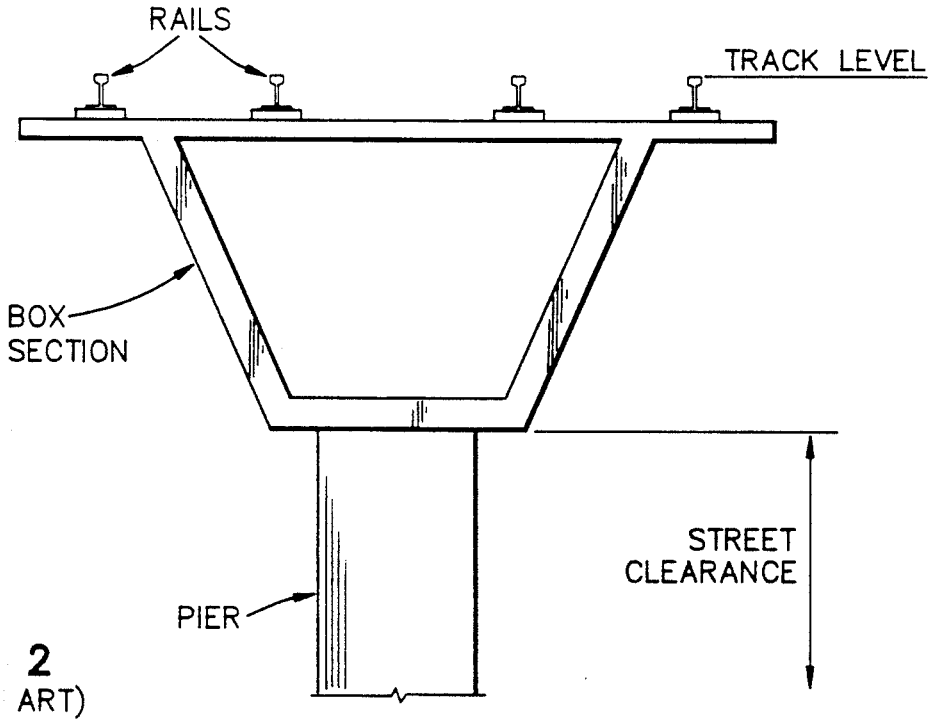
FIG. 2 (PRIOR ART)
FIG. 2 is a diagrammatic view showing a cross-section of a second prior art rapid transit viaduct structure.
Figure 3:
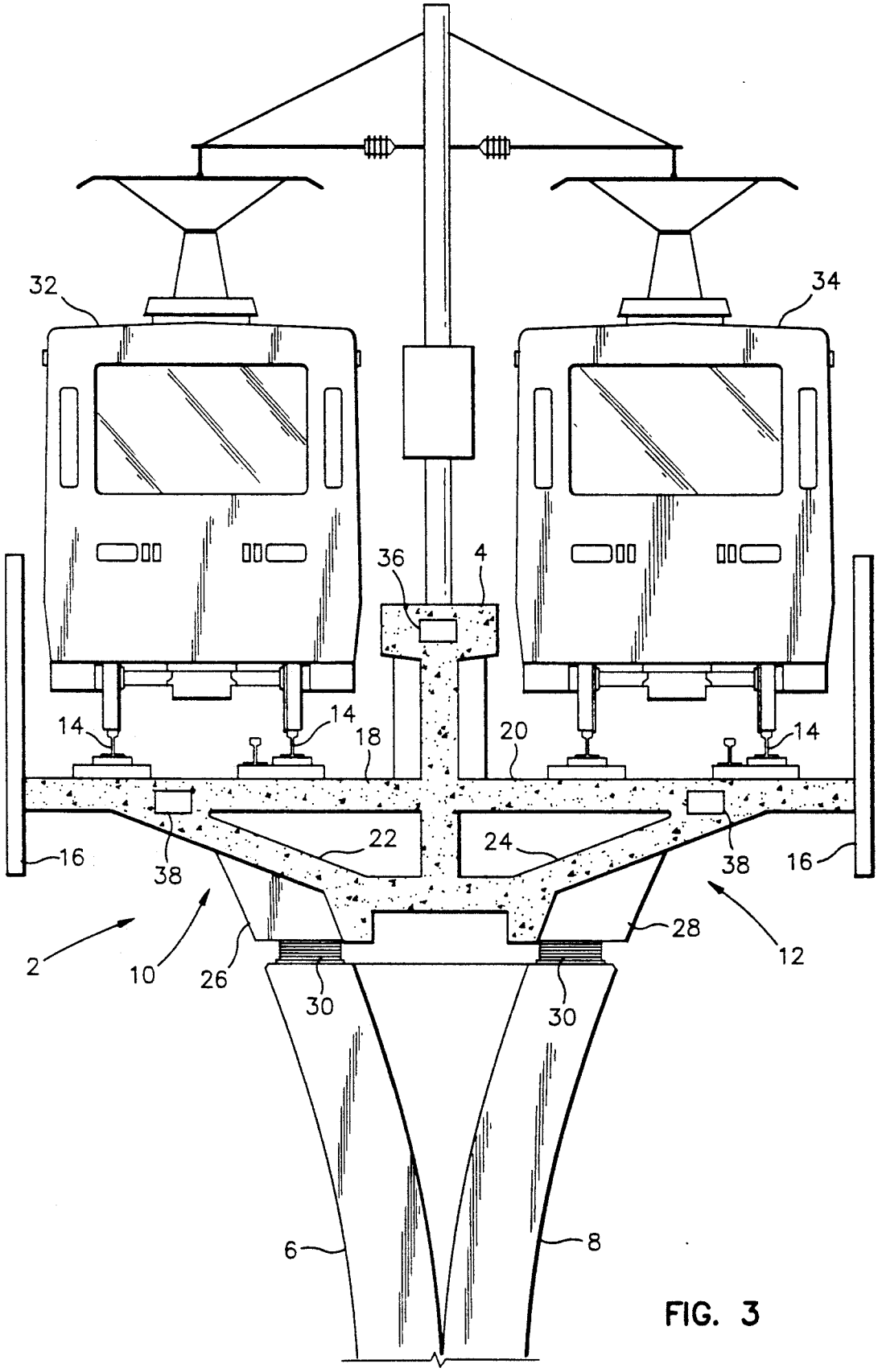
FIG. 3 is a partial diagrammatic view showing a cross-section of a rapid transit viaduct system constructed in accordance with the present invention.

Referring now to FIG. 3, a rapid transit viaduct section 2 includes a central load bearing span or body member 4 supported by a pair of upright pier members 6 and 8. Extending laterally from opposite lower side portions of the central body 4 are a pair of lateral platform structures 10 and 12. Each of the platform structures 10 and 12 has a pair of rails 14 mounted thereon for carrying a rapid transit vehicle. In addition, each of the platform structures may be provided with an upright side wall section 16 as required by safety, noise pollution, and other considerations. One or more sets of rails 14 are carried by each of the lateral platform structures depending on the requirements of the rapid transit system.

The platform structures 10 and 12 each include respective upper platform decks 18 and 20, and respective lower support struts 22 and 24. The lower support struts 22 and 24 are mounted as close to the bottom of the central load bearing body 4 as practicable. Deck members 18 and 20 are mounted to the central body 4 at an intermediate portion thereof above the support struts 22 and 24. The support struts angle upwardly from their point of attachment with the load bearing body 4 until they intersect the deck members. As such, the deck members 18 and 20 and support struts 22 and 24 form a box section providing resistance to torsional loading caused by track curvature and differential train loading. This box section may be considered a closed base. The load bearing body 4 bisects the closed base and extends vertically upwardly therefrom to provide span-wise bending resistance. Preferably, the entire viaduct section 2 is cast as a single reinforced concrete cross-section.

The platform sections 10 and 12 each include lower pier mounts 26 and 28. These are mounted respectively to the bottom of the supports struts 22 and 24. The pier mounts 26 and 28 are in turn supported, respectively, on the piers 6 and 8 using a plurality of Neoprene pads 30, which provide a cushioned support for the structure.

The viaduct section 2 forms part of a viaduct system supporting rails 14 for carrying rapid transit vehicles 32 and 34. These vehicles are conventional in nature and may be powered electrically as shown in FIG. 3. As discussed in more detail below, the viaduct section 2 may be cast in place as an elongated span-wise section or may be formed as a precast modular segment. In the latter instance, the viaduct section 2 is combined with other viaduct sections to form a precast segmental structure. To facilitate that construction, the load bearing body 4 may be formed with an interlock member 36, while the lateral platform structures 10 and 12 may each be formed with interlock members 38.

Figure 4:
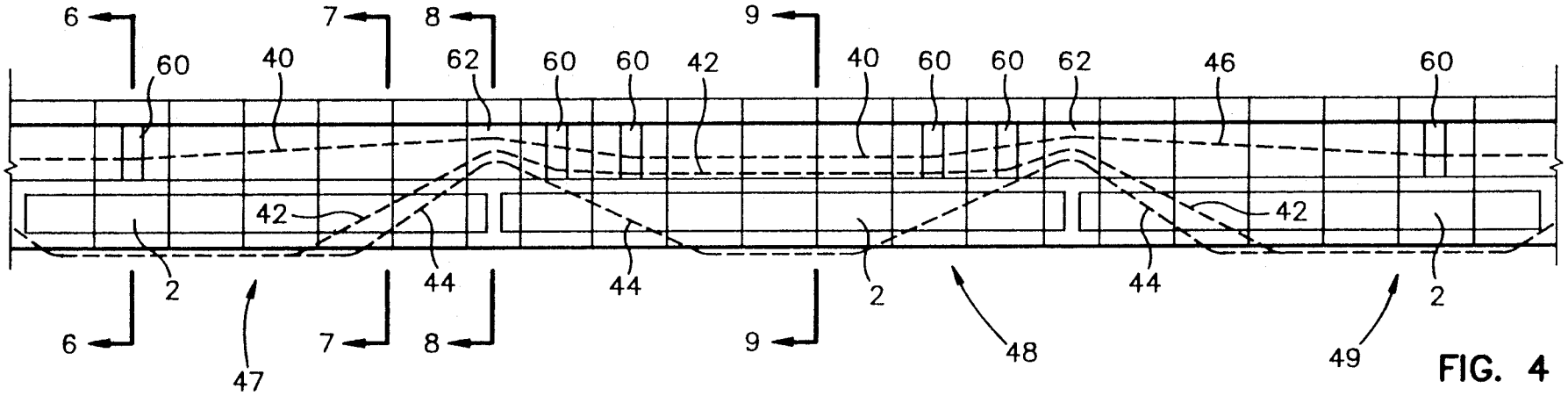
FIG. 4 is an elevational side view of the viaduct system of FIG. 3.
Figure 5:
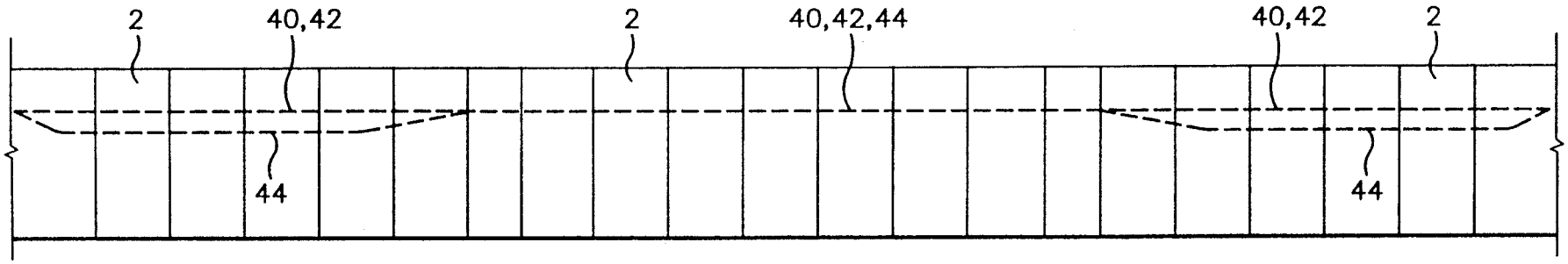
FIG. 5 is a plan view of the viaduct system of FIG. 4.
Figure 6:
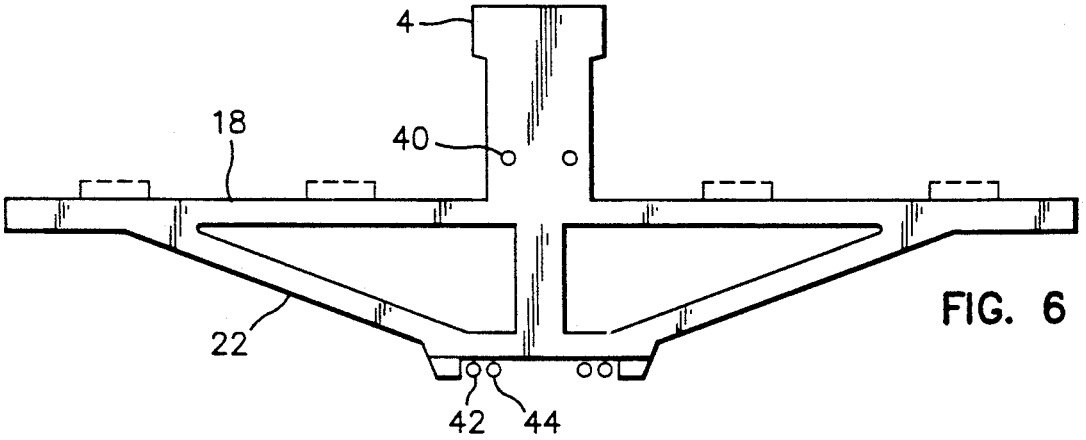
FIG. 6 is a diagrammatic cross-sectional view taken along lines A—A in FIG. 4.
Figure 7:
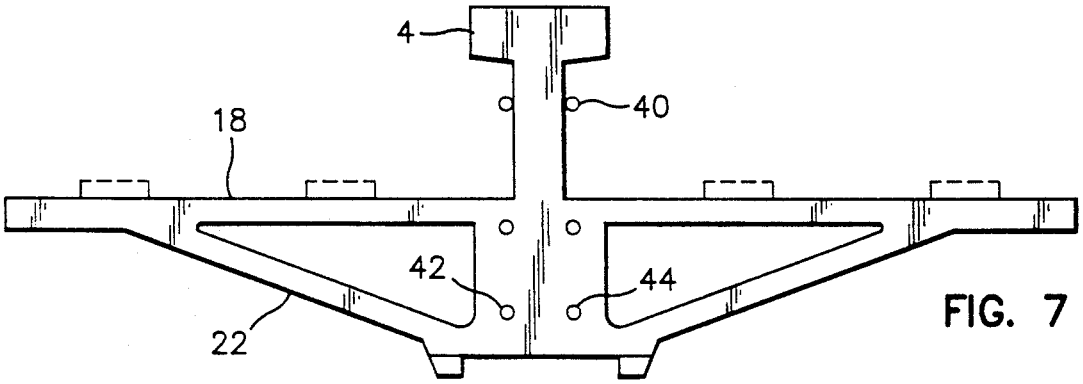
FIG. 7 is a diagrammatic cross-sectional view taken along lines B—B in FIG. 4.
Figure 8:
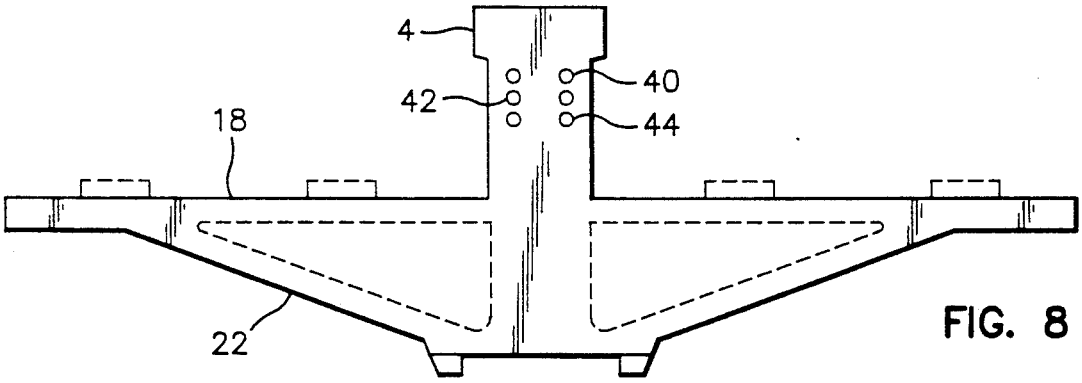
FIG. 8 is a diagrammatic cross-sectional view taken along lines C—C in FIG. 4.
Figure 9:
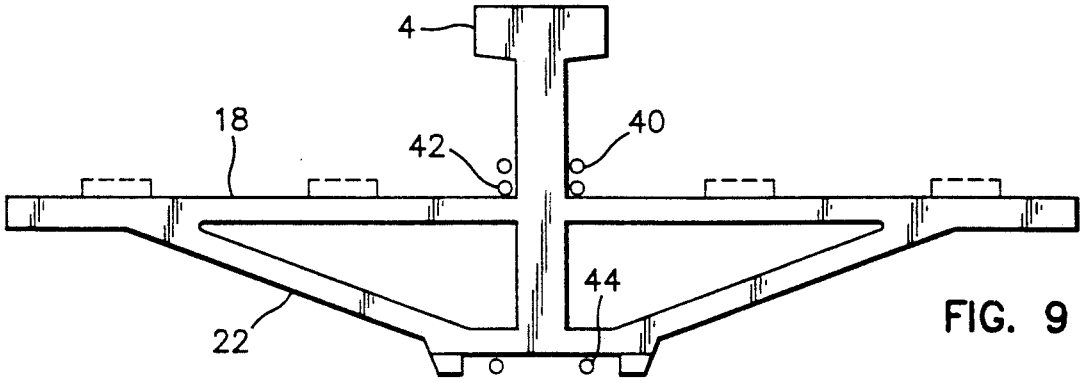
FIG. 9 is a diagrammatic cross-sectional view taken along lines D—D in FIG. 4.

Referring now to FIGS. 4 and 5, a viaduct system is formed from a plurality of precast viaduct sections 2 formed as modular segments and combined as a precast segmental structure extending between sequentially positioned piers (not shown). The viaduct sections 2 are placed in longitudinally abutting relationship. To facilitate that construction, the viaduct sections are preferably match cast so that the abutting end portions thereof fit one another in an intimate interlocking relationship. Each successive section is therefore cast against a previously cast adjacent section to assure interface continuity.

The connection between adjacent modular sections is further secured by way of the interlock members 36 and 38. On one end of each viaduct section 2 the interlock members 36 and 38 are formed as external keys. On the opposite end of each viaduct section 2 the interlock members are formed as an internal slot or notch, corresponding to the key members of the adjacent viaduct section. Match casting assures that corresponding keys and slots, as well as the remaining interface surfaces, properly interfit one another.

In the viaduct system of FIGS. 4 and 5, the viaduct sections 2 are bound together with one or more post tensioning cables or tendons 40, 42 and 44. The number of cables used will depend on a number of factors such as cable thickness, span length and loading requirements. The tensioning cables are each routed along a predetermined serpentine path which varies in vertical and lateral position along the span of the segmental viaduct structure.

In FIGS. 4 and 5, the viaduct system is shown as having three segmental spans 47, 48 and 49, the ends of which are supported by pier structures (not shown) of the type illustrated in FIG. 3. FIGS. 6, 7, 8 and 9 illustrate, diagrammatically, the manner in which the post tensioning cables 40, 42 and 44 vary in vertical and lateral position as they pass through these spans. The figures also reveal that the post tensioning cables are sometimes positioned within the viaduct sections themselves, and at other times are positioned externally thereof.

Figure 10:
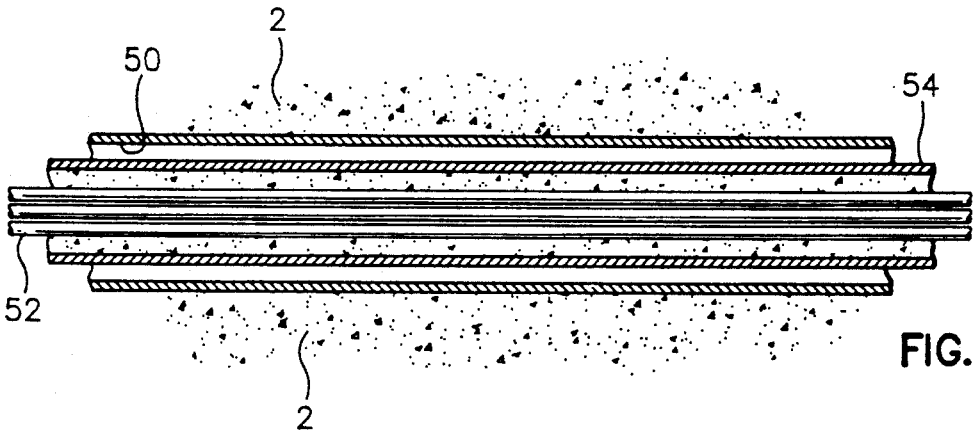
FIG. 10 is a projected diagrammatic view showing the routing of a post tensioning cable in the viaduct system of FIG. 4.

Referring now to FIG. 10, it will be seen that the viaduct sections 2 are formed with appropriate guide ducts 50 at locations where the post tensioning cables pass through the viaduct structure. The post tensioning cables, identified collectively by reference numeral 52 in FIG. 10, are routed through the guide ducts 50. To facilitate that routing, a continuous flexible conduit 54 is initally inserted through the guide ducts, and the post tensioning cables 52 are thereafter placed in the conduit. The conduit 54 may be advantageously formed from polyethylene pipe but could also be formed from flexible metallic materials. The post tensioning cables 52 are tensioned using conventional post tensioning apparatus and the interior of the conduit 54 is cement grouted along the entire length thereof for corrosion protection.

As indicated, the routing path of the post tensioning cables 40, 42 and 44 may at times lie externally of the viaduct sections, above and below the lateral platform structures 10 and 12. Below the platform structures, the bottom of the viaduct section itself supports the post tensioning cables. Above the platform structures, post tensioning cable routing is facilitated using deviator structures 60, the locations of which are illustrated in FIG. 4. The viaduct sections at the ends of each viaduct span are also provided with cable end mounts 62 which also function to route the tensioning cables.

Figure 11:
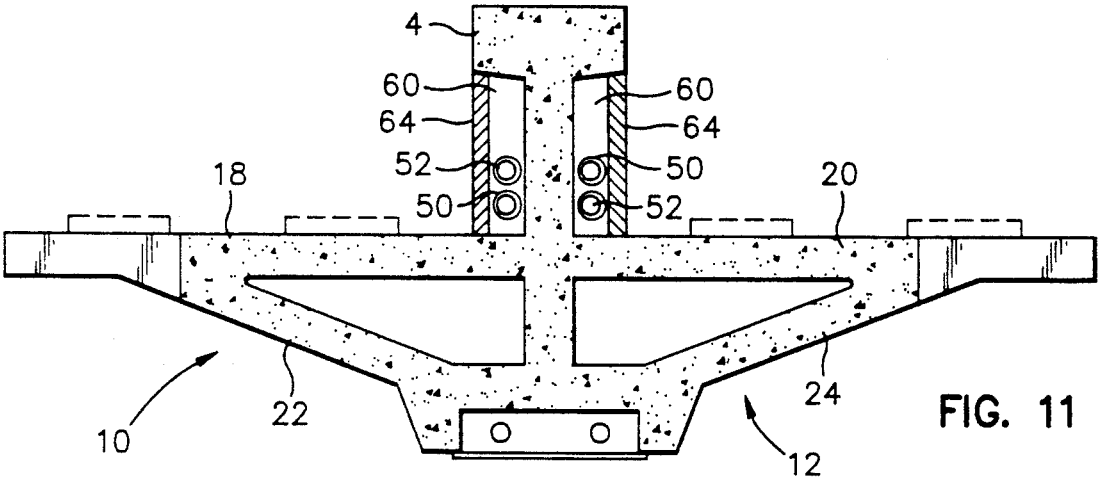
FIG. 11 is a view through a cross-section of the viaduct system of FIG. 4, showing the construction of a post tensioning cable deviator and cover plate.

FIG. 11 illustrates a cross-section taken through one of the deviators 60. The deviators 60 are preferably formed of concrete and cast directly into the viaduct section 2. Each deviator 60 is formed with one or more guide ducts 50 for receiving one of the conduits 54. Optionally, a pair of side cover plates 64, made from steel or the like, may be mounted along the entire viaduct span, exteriorly of the deviators 60. The cover plates provide protection against damage to the exposed portions of the post tensioning cables positioned above the deck members 18 and 20.

Figure 12:
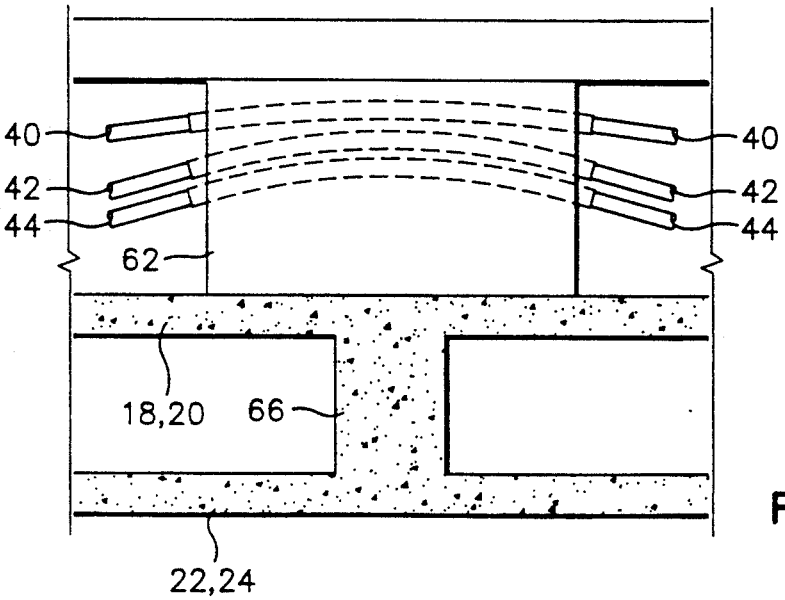
FIG. 12 is a view through a cross-section of the viaduct system section of FIG. 11, showing the construction of post tensioning cable supports and lower support brace.

Referring now to FIG. 12, the cable end mounts 62 are illustrated. Like the deviators 60, the end mounts 62 are preferably made from concrete and cast as part of the viaduct section. The support mounts 62 are also formed with one or more guide ducts 50 for receiving one of the conduits 54. In addition, because the end mounts 62 must support substantial downward loads imparted by the tensioning cables, there is provided between the deck sections 18 and 22 and lower support struts 22 and 24, a lower support brace 66.

Figure 13:
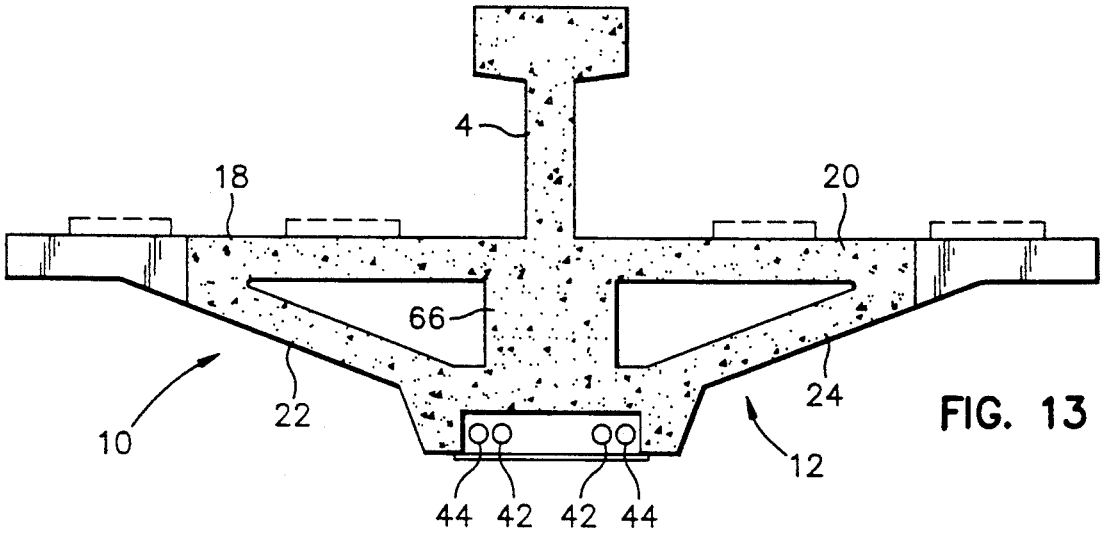
FIG. 13 is a view through a cross-section of the viaduct system of FIG. 4, showing the construction of a lower post tensioning cable support section.

Referring now to FIG. 13, and as previously stated, some of the post tensioning cables are routed through the lateral platform structures 10 and 12 to the bottom of the viaduct section. To support the post tensioning cables during their transition through the platform sections 10 and 12, the central body member 4 may be provided with lower cable routing blocks 66.

Figure 14:
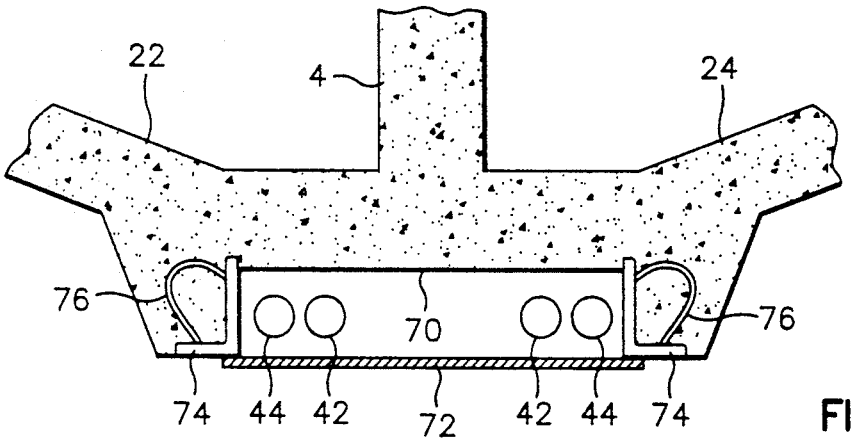
FIG. 14 is an enlargement of the section of FIG. 13, showing a system for routing tensioning cables along the bottom the viaduct system of FIG. 4.
Figure 15:
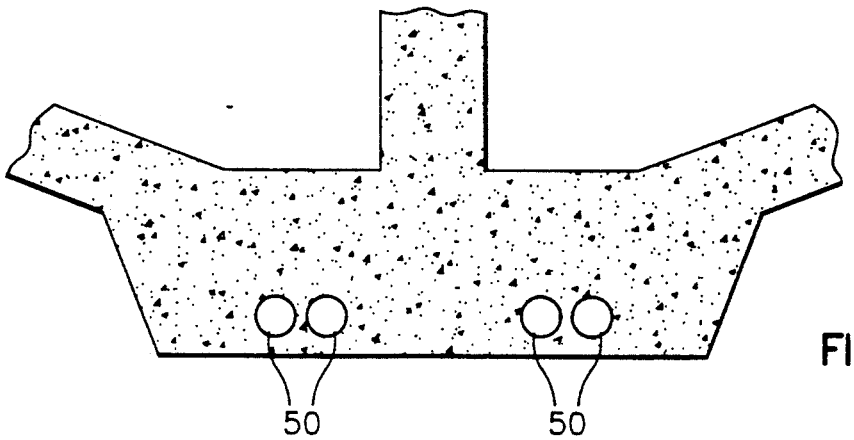
FIG. 15 is a detailed cross-sectional view showing an alternative system for routing tensioning cables along the bottom of the viaduct system of FIG. 4.

Referring now to FIGS. 14 and 15, the post tensioning cables extending along the bottom of the viaduct structure may be located either externally of the structure, as shown in FIG. 14, or internally therein, as shown in FIG. 15. In the external construction of FIG. 14, the viaduct section is provided with a lower channel 70 centered below the central body member 4. The channel 70 serves as a guide for the post tensioning cables. To protect the post tensioning cables against damage from vehicle collisions, fire and environmental damage, the channel 70 is covered with a longitudinal plate 72 extending along the bottom of the viaduct span. In order to attach the longitudinal plates 72, each viaduct section is provided with a mounting angle 74 positioned on each side of the channel 70. The mounting angles 74 are embedded in the concrete viaduct section using shear connectors 76 which are welded to the mounting angles. The longitudinal plate 72 is bolted to the mounting angles 74. To facilitate that connection, the mounting angles 74 are drilled at appropriate locations prior to casting the viaduct section, and threaded nuts are welded over the drill holes on top of the mounting angles.

In those cases where the lower tensioning cables are mounted internally to the viaduct section, as illustrated in FIG. 15, the viaduct section 2 is formed without the longitudinal channel 70. Instead, one or more cable guide ducts 50 are formed therein, as appropriate.

Figure 16:
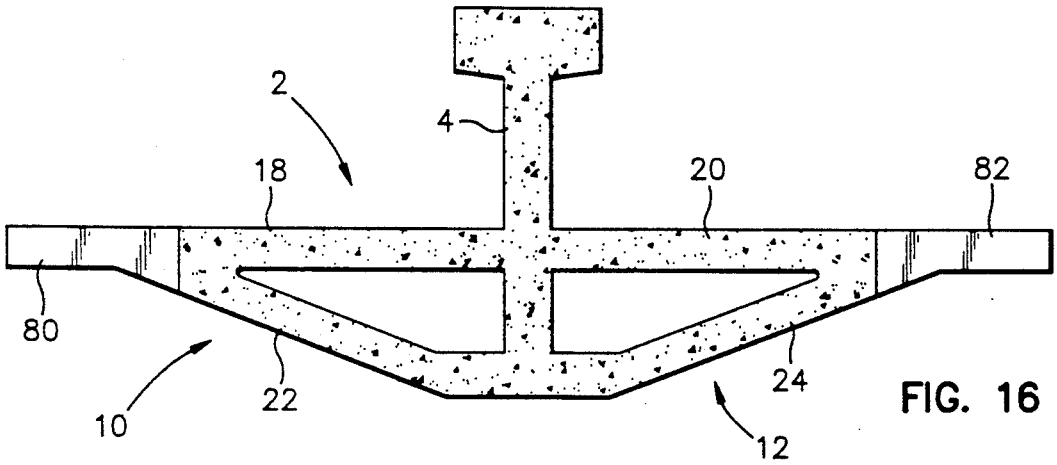
FIG. 16 is a diagrammatic view of a cross-section of the viaduct system of FIG. 4 showing a fabrication method therefor.

Referring now to FIG. 16, it is asserted that longitudinal stresses in the viaduct structure may be controlled by limiting the continuity of the structure to certain areas (i.e., the outboard portions of the platform decks 18 and 20) of the viaduct sections. This is particularly advantageous because it allows more efficient (cost saving) use of the post tensioning cables. The ability to limit section continuity is due in part to the fact that the platform decks 18 and 20 can be located at the approximate middle (i.e., the neutral axis) of the viaduct section, depth-wise, so that they do not contribute to the resistance of the section in response to externally applied loads. This limited continuity can be built into the viaduct structure during slab formation, if the structure is cast in place, or cast in the end faces of the pre-cast segments if the viaduct structure is built using the pre-cast segmental method.

In FIG. 16, areas of discontinuity 80 and 82 are provided in the lateral deck sections 18 and 20, respectively. These areas of discontinuity are gaps which prevent the transfer of compression loads along the longitudinal viaduct span. The gaps are formed using segments of very thin spacer material positioned at the outboard portions of the lateral deck sections 18 and 20. For this purpose, any number of soft or resilient materials may be used. In the event the viaduct structure is cast in place, the spacers would be appropriately positioned in the concrete mold. When a pre-cast segmental method is used, the spacers are appropriately positioned during the match casting process. Conveniently, the spacers may be formed by painting a layer of grease on the previously cast section. That is because the gap required to provide the areas of discontinuity 80 and 82 need not be large, i.e., typically about 0.01 inches.

Figure 17:
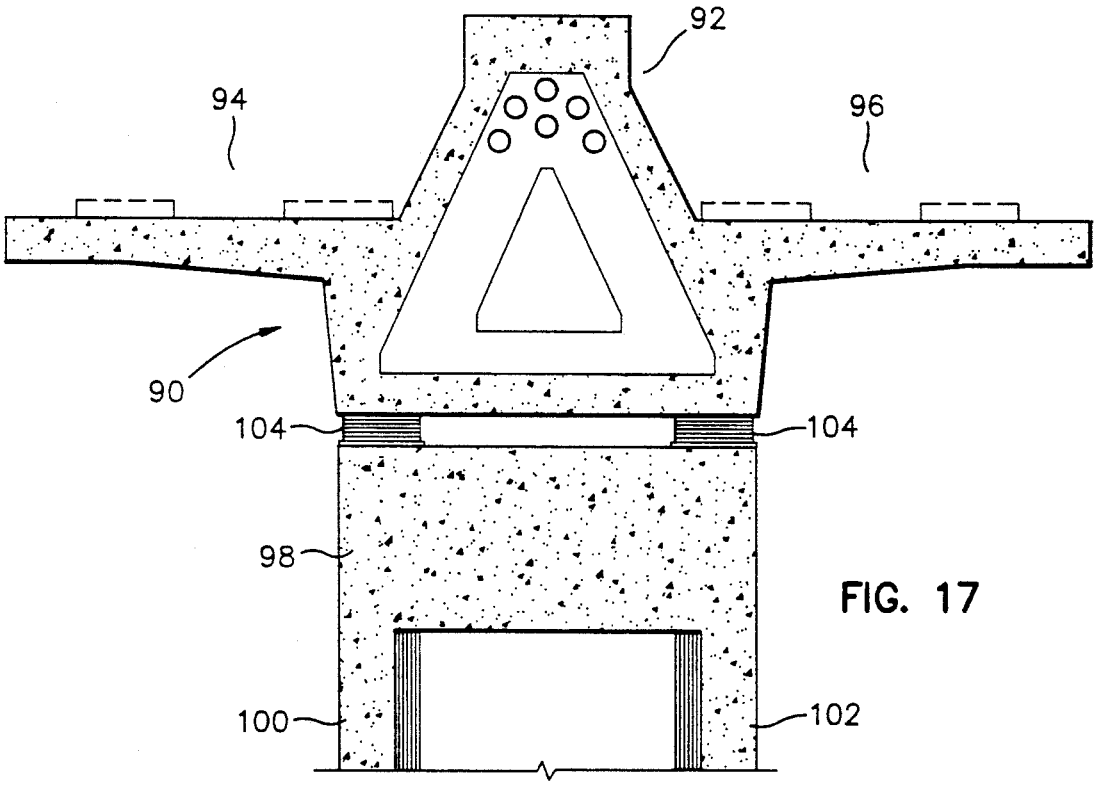
FIG. 17 is a diagrammatic view showing a rapid transit viaduct section constructed in accordance with another aspect of the invention.

Viaduct sections may be formed in accordance with the present invention in a variety of configurations. The central load bearing body, for example, could be formed as an I section, an H section, or a variety of other section shapes. The load bearing body could also be a box section. In the embodiment of FIG. 17, a viaduct section 90 includes a central triangular load bearing body 92 and a pair of lateral platform structures 94 and 96. In this configuration, the central load bearing body forms part of a closed, torsion resistant base section as well as a central load bearing member. The viaduct section 90 is mounted on a pier 98 having upright pier elements 100 and 102. Neoprene pads 104 are provided between the viaduct section 90 and the pier 98.

Figure 18:
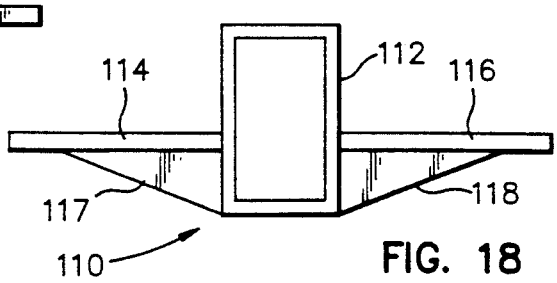
FIG. 18 is a diagrammatic view showing a rapid transit viaduct section constructed in accordance with another aspect of the invention.

In a further embodiment, shown in FIG. 18, a viaduct section 110 includes a generally rectangular load bearing body 112 having mounted thereto lateral platform structures 114 and 116. The lateral platform structures are supported by support ribs 117 and 118. In this configuration, the lower "U" shaped portion of the load bearing body 112 forms part of a closed, torsion resistant base section. The upper "U" shaped portion of the load bearing body 112 also forms part of the closed base section and serves additionally as a central load bearing member.

Figure 19:
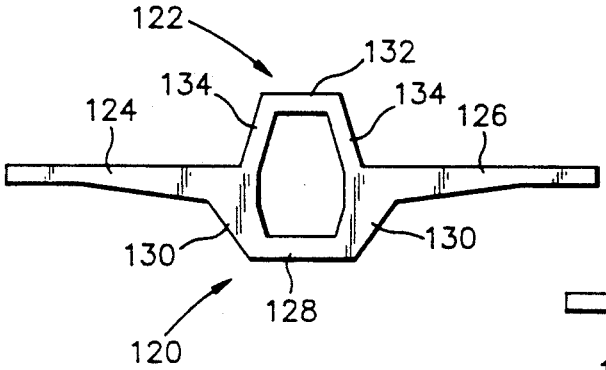
FIG. 19 is a diagrammatic view showing a rapid transit viaduct section constructed in accordance with another aspect of the invention.

In a still further embodiment, shown in FIG. 19, a viaduct section 120 includes a central hexagonal load bearing body 122 having a pair of lateral platform structures 124 and 126 mounted to a lower portion thereof. The load bearing body 112 includes a lower horizontal flange 128 and a pair of lower webs 130 extending upwardly and outwardly therefrom. These components together form part of a closed, torsion resistant base section. The load bearing body 112 further includes an upper horizontal flange 132 and a pair of upper webs 134 extending downwardly and outwardly therefrom to meet the upwardly extending lower webs 130. The components 132 and 134 together form part of the closed base section and serve additionally as a central load bearing member.

Thus, in accordance with the present invention, instead of placing a rapid transit support structure under the rails, a load bearing structure is placed between the tracks. In a preferred aspect, an inverted "T" structure is utilized to provide the lowest possible platform height. A major advantage of this system is a considerable reduction in the total depth of the structure and a concomitant lowering of the track. By concentrating all loads in the middle of the deck, all along the structure, there is also realized a reduction in the transverse transfer of loads from girders to piers, thus reducing the pier dimensions.

The central load bearing body, being positioned between the rapid transit vehicles, also reduces the risk of vehicle collision in case of a derailment and facilitates guidance of the vehicles to reduce the possibility of derailment. Aesthetically speaking, the viaduct structure looks more slender because of the reduced depth thereof compared to the prior art proposals. This is due to the fact that the track level is positioned intermediately of the central load bearing body and barriers such as the side walls section 16 can be installed to hide the depth of the load bearing body. This is an important consideration for a viaduct in an urban area where the visual impact of a continuous elevated concrete deck must be minimized. Finally, the reduced height of the tracks results in smaller access structures if the tracks need to be brought to the ground level at the ends of the line.

While preferred embodiments of the rapid transit viaduct system have been described, it should be understood that modifications and adaptations thereof will occur to persons skilled in the art. Therefore, the protection afforded the invention should not be limited except in accordance with the spirit of the following claims and their equivalents.

I claim:

1. A railway viaduct system comprising:

a central load bearing body;

a plurality of upright piers disposed below and supporting said central body;

a pair of lateral platform structures cantilevered outwardly from opposite lower side portions of said central body and supported by said central body;

at least one pair of vehicle support rails disposed on each of said platform structures; and said central body extending upwardly from said lateral platform structures to provide a barrier between said pairs of vehicle support rails disposed on each of said platform structures

2. The viaduct system of claim 1 wherein said central body is supported directly on said piers.

3. The viaduct system of claim 1 wherein said viaduct system is formed from a plurality of longitudinally abutting modular sections extending between successive pairs of piers, said modular sections each including a central load bearing body and a pair of said lateral platform structures.

4. The viaduct system of claim 1 wherein said lateral platform structures are integrally formed with said central body.

5. The viaduct system of claim 1 wherein said modular sections include key members configured to match with corresponding slots in adjacent modular sections.

6. The viaduct system of claim 1 wherein said central load bearing body is a "T" section.

7. The viaduct system of claim 1 wherein said central load bearing body is a triangular box section.

8. The viaduct system of claim 1 wherein said central load bearing body is a generally rectangular box section.

9. The viaduct system of claim 1 wherein said central load bearing body is a generally hexagonal box section.

10. The viaduct system of claim 3 wherein said modular sections are connected in a span-wise direction by post tensioning tendons and wherein said modular sections are provided with guide ducts and deviator structures for guiding and positioning said tendons.

11. The viaduct system of claim 3 wherein said modular sections include areas of discontinuity formed on outboard portions of said lateral platform structures, said areas of discontinuity being configured to prevent compression load transfer between adjacent ones of said modular sections.

12. The viaduct system of claim 10 further including flexible conduits disposed in said guide ducts, and wherein said post tensioning tendons are fixed in said conduits with cement grout.

13. The viaduct system of claim 10 wherein portions of said post tensioning tendons extend below and externally of said modular sections, and wherein said modular sections are provided with a post tensioning tendon guide channel and a cover plate mounted to the bottom of said modular sections to cover said guide channel.

14. A railway viaduct system comprising:

a central load bearing span member;

a closed base section mounted to a lower portion of said central span member;

a pair of lateral platform members mounted to opposite side portions of said closed base section and supported by said central load bearing span member;

at least one pair of vehicle support rails disposed on each of said platform members; and a plurality of upright piers disposed below and supporting said central span member.

15. The viaduct system of claim 14 wherein said closed base section includes upper deck members and lower support struts and wherein said lateral platform members are formed in part by said upper deck members.

16. The viaduct system of claim 15 wherein said upper deck members are positioned at the approximate vertical mid-point of said central span member.

17. The viaduct system of claim 14 wherein said central span member is a reinforced concrete "T" beam section.

18. The viaduct system of claim 14 wherein said central span member has an inverted U-shape and forms an upper portion of said closed base section in conjunction with a lower upright U-shaped base structure.

19. The viaduct system of claim 14 wherein said central body forms part of said closed base section and includes an upper horizontal flange and a pair of upper web sections extending downwardly and outwardly from said base section, and wherein said closed base section further includes a lower horizontal flange section and a pair of lower web sections extending upwardly and outwardly therefrom to meet said upper web sections, and wherein said lateral platform members extend laterally from an intersection of said upper and lower web sections.

20. A railway viaduct system comprising:

a lateral deck structure having a plurality of pairs of vehicle support rails positioned thereon, said viaduct system further including a central load bearing span member supporting said desk structure and extending upwardly from said lateral deck structure, and a plurality of upright piers disposed below and supporting said central span member.

* * * * *